US008746453B1

(12) United States Patent
Hall et al.

(10) Patent No.: US 8,746,453 B1
(45) Date of Patent: Jun. 10, 2014

(54) DOUBLE-HANDLE, STACKABLE, POURABLE PRODUCT CONTAINER

(71) Applicant: Buddeez, Inc., Wentzville, MO (US)

(72) Inventors: Charles E. Hall, Wentzville, MO (US); William A. Hall, Dardenne Prairie, MO (US)

(73) Assignee: Buddeez, Inc., Wentzville, MO (US)

( * ) Notice: Subject to any disclaimer, the term of this patent is extended or adjusted under 35 U.S.C. 154(b) by 0 days.

(21) Appl. No.: 13/777,746

(22) Filed: Feb. 26, 2013

Related U.S. Application Data

(63) Continuation-in-part of application No. 29/444,429, filed on Jan. 30, 2013.

(51) Int. Cl.

| | |
|---|---|
| ***B65D 21/02*** | (2006.01) |
| ***B65D 21/032*** | (2006.01) |
| ***B65D 21/028*** | (2006.01) |
| ***B65D 85/62*** | (2006.01) |

(52) U.S. Cl.
USPC ..... 206/504; 206/509; 206/511; 220/669; 215/382; 215/383; 215/384; 215/385; 222/466

(58) Field of Classification Search
USPC ..... 206/509, 511, 504; 222/466; 215/375, 215/382–385
See application file for complete search history.

(56) References Cited

U.S. PATENT DOCUMENTS

| | | | | |
|---|---|---|---|---|
| 2,641,374 | A * | 6/1953 | Der Yuen | 215/10 |
| 3,194,426 | A * | 7/1965 | Brown, Jr. | 220/23.4 |
| 5,307,956 | A | 5/1994 | Richter et al. | |
| 6,053,345 | A | 4/2000 | Jones | |
| D461,719 | S * | 8/2002 | Nicodemus et al. | D9/533 |
| 6,588,612 | B1 * | 7/2003 | Dorn et al. | 215/10 |
| D653,114 | S | 1/2012 | Rivera et al. | |
| 8,403,144 | B2 * | 3/2013 | Eiten | 206/509 |
| 8,439,214 | B2 * | 5/2013 | Darr et al. | 215/382 |
| 2010/0326872 | A1 | 12/2010 | Rivera et al. | |

* cited by examiner

*Primary Examiner* — Fenn Mathew
*Assistant Examiner* — Jennifer Castriotta
(74) *Attorney, Agent, or Firm* — Joseph M. Rolnicki; Evans & Dixon, LLC

(57) ABSTRACT

A plastic blow molded pourable product container is constructed to support the combined weight of additional like containers stacked on top of the container, and is also constructed to efficiently use a three dimensional space occupied by a stack of containers and to resist relative movement between adjacent containers assembled together in a three dimensionally arrayed stack of the containers.

9 Claims, 14 Drawing Sheets

DOUBLE-HANDLE, STACKABLE, POURABLE PRODUCT CONTAINER

FIELD

The present invention pertains to a plastic container that is constructed to support the combined weight of additional like containers stacked on top of the container, and is also constructed to efficiently use a three dimensional space occupied by a stack of the containers and to resist relative movement between adjacent containers assembled together in a three dimensionally arrayed stack of the containers.

BACKGROUND

Pourable product containers, for example plastic blow molded one gallon liquid containers used to transport liquid products such as milk and fruit juices, or pourable granular products such as salt or pet food from a product producer to a product retailer have for some time been associated with the problem of transporting the product containers efficiently.

Efficient transport of product containers basically requires that as many containers as possible be fit into the smallest area for transporting. For example, containers such as cardboard or paperboard boxes containing goods are typically arranged in a tight fit three dimensional array on a pallet surface to efficiently transport the boxes. A tight fit two dimensional array of boxes is arranged as a bottom layer of boxes on the pallet surface. Additional tight fit two dimensional arrayed layers of boxes are stacked on top of the bottom layer. This results in a three dimensional tight fit arrangement of boxes on the pallet that can be efficiently transported.

With pourable product containers such as plastic blow molded gallon containers or bottles, it is not possible to fully employ the same technique of arranging a three dimensional stack of boxes on a pallet. Conventional plastic blow molded containers do not have a sufficient structural strength to support the weight of additional blow molded plastic containers, one on top of another. They also don't typically include features that enable the containers to be arranged in a tight fit two dimensional array or features that resist relative movement between adjacent containers that are arranged in a three dimensional array of containers.

There is a need for a plastic blow molded one gallon container construction that is sufficiently structurally strong to support the combined weight of additional stacked containers while also efficiently using a three dimensional space occupied by a three dimensional array of the containers and resisting relative movement between adjacent containers in the array.

SUMMARY

The pourable product container of the present invention overcomes the disadvantages associated with plastic blow molded liquid containers by providing a plastic blow molded pourable product container with a structure that is sufficiently strong to support several like containers stacked on top of the container. In addition, the container of the present invention is provided with a novel construction that enables a plurality of the containers to be arranged in a tightly packed, space efficient two dimensionally arrayed layer. The container construction resists relative movement between adjacent containers in the two dimensionally arrayed layer of the containers and resists relative movement between adjacent containers in a stack of the containers.

The pourable product container of the invention is a plastic blow molded one gallon container. However, the concepts of the invention can be employed in other sizes of plastic containers. The container has a general cubic configuration with a rectangular or square top surface, a rectangular or square bottom surface and four side surfaces that extend between the top surface and bottom surface.

The top surface has a cylindrical neck that surrounds an opening to the interior of the container. The neck is centered in the top surface. An upwardly sloped surface area of the top surface surrounds the neck. A pair of short, narrow troughs are depressed into the sloped surface area. The troughs extend outwardly from opposite sides of the neck toward opposite corners of the container.

The bottom surface has at least one cylindrical interior wall that is recessed into the bottom surface. The cylindrical interior wall surrounds a cavity that is centered in the bottom surface. An upwardly sloped surface area of the bottom surface surrounds the cavity. A pair of short, narrow ridges project from the sloped surface area. The ridges extend outwardly from the opposite sides of the cavity toward opposite corners of the container and are aligned with the troughs in the top surface of the container. The cavity of an upper container is dimensioned to receive the container neck and an attached cap of a lower container when the sloped bottom surface area of the upper container is positioned on top of the sloped top surface area of the lower container. The ridges of the upper container are dimensioned to be received in the troughs of the lower container. The neck of the lower container and a cap attached to the neck fit into the cavity of the upper container and provide a coupling or link between the stacked containers that allows for only limited relative side to side movement between the upper and lower containers. Additionally, the ridges of the upper container fit into the troughs of the lower container provide a coupling or link between the stacked containers that allow for limit relative side to side movement as well as limited rotational movement between the containers.

Two of the four side surfaces of the container are constructed with pluralities of concave groove surface sections. The concave groove surface sections extend between the container top surface and bottom surface and are sequentially arranged across each of the two side surfaces of the container. The opposite ends of the groove surface sections merge with the container top surface and bottom surface, and thereby form each of the two side surfaces as corrugation reinforced structures between the container top surface and bottom surface.

The other two side surfaces of the container are constructed with pluralities of convex rib surface sections. The convex rib surface sections extend between the container top surface and bottom surface and are sequentially arranged across each of the two side surfaces. The opposite ends of the convex rib surface sections merge with the container top surface and bottom surface, and thereby form each of the other two side surfaces as corrugation reinforced structures between the container top surface and bottom surface.

The convex rib surface sections are complementary to the concave groove surface sections, wherein the convex rib surface sections of one container fit into the concave groove surface sections of a second container. This enables a plurality of the containers to be arranged in a tightly packed, space efficient two dimensionally arrayed layer with the convex rib surface sections and the concave groove surface sections of adjacent containers engaging each other. This enables forming a tight fit two dimensional arrayed layer of the containers on a pallet that resists relative movement between adjacent containers and makes efficient use of the pallet surface. Additionally, the concave groove surface sections and convex rib surface sections of each container in the two dimensionally arrayed layer of containers provide the bottom layer of containers with enhanced structural strength for supporting additional two dimensional arrayed layers of containers stacked on the bottom layer of containers. Furthermore, the necks and attached caps of each of the containers in the two dimensionally arrayed lower layers engage in the cavities of each of the containers in the two dimensionally arrayed upper layers and limit relative movements between the stacked layers of containers.

Each of the four side surfaces of the container are constructed where the surfaces bow inwardly toward the interior of the container between the top and bottom surfaces of the container. The inwardly bowed configuration of the side surfaces pre-loads the surfaces inwardly and reinforces the surfaces against bulging outwardly when the container is filled.

A pair of handles are formed in the container side surfaces at opposite corners of the container. The pair of handles not only make carrying a filled container easier, but the constructions of the handles at the opposite corners of the container add structure that reinforce these corners for supporting the loads of several stacked filled containers.

The other, opposite corners of the container between the pair of handles are formed with grooves in the corners. The grooves extend upwardly across the corners from adjacent the bottom of the container to the top surface of the container, and then extend inwardly across the container top surface toward the neck of the container. These grooves also add structure and reinforce their associated corners for supporting the loads of several stack filled containers.

One of the side surfaces of the container is also provided with a planar surface area. This area can be used for easy attachment of a label.

The plastic blow molded container of the invention described above has enhanced structural strength to support additional layers of like containers stacked on the container. Furthermore, the construction of the container described above resists relative movement between adjacent containers in a two dimensionally arrayed layer of containers and resists relative movement between containers stacked on each other. Further features of the container of the invention are set forth in the following description of the drawing figures and in the detailed description of the invention.

BRIEF DESCRIPTION OF THE DRAWING FIGURES

DETAILED DESCRIPTION OF THE INVENTION

Figure 1:
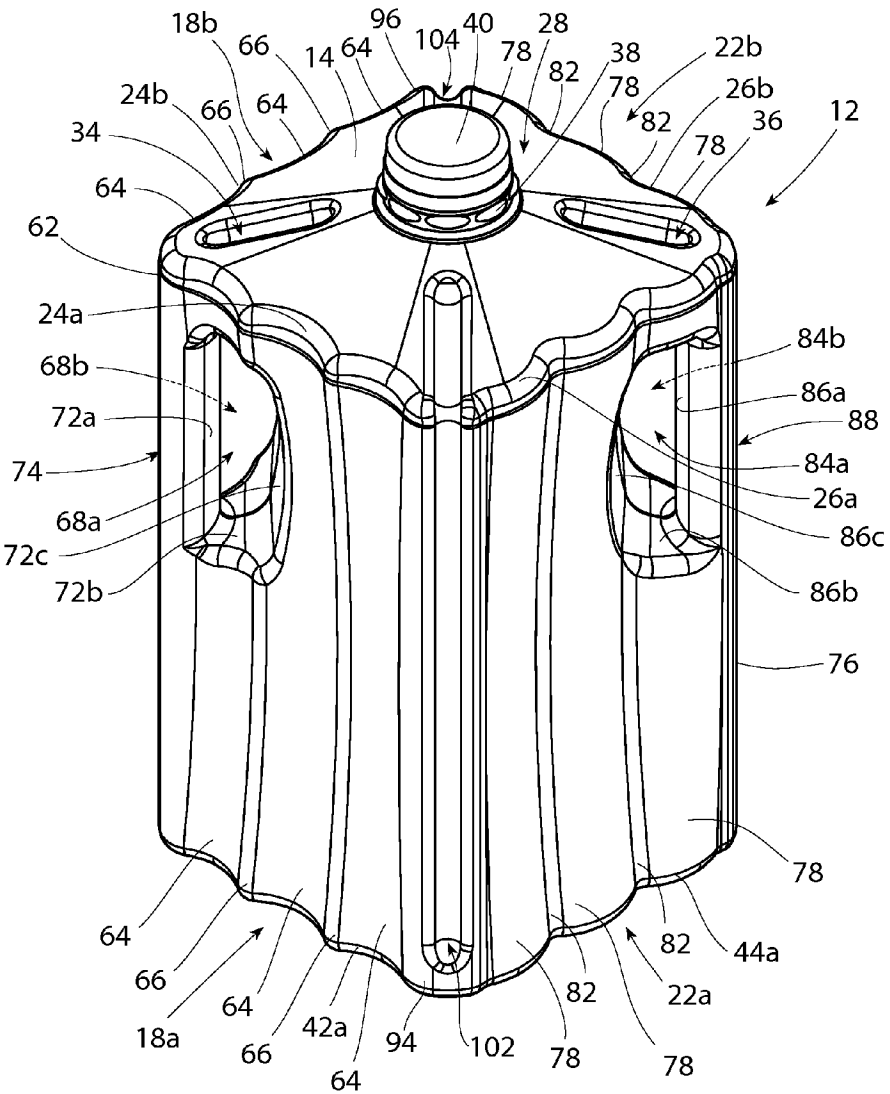
FIG. 1 is an upper perspective view of the stackable pourable product container of the invention.
Figure 2:
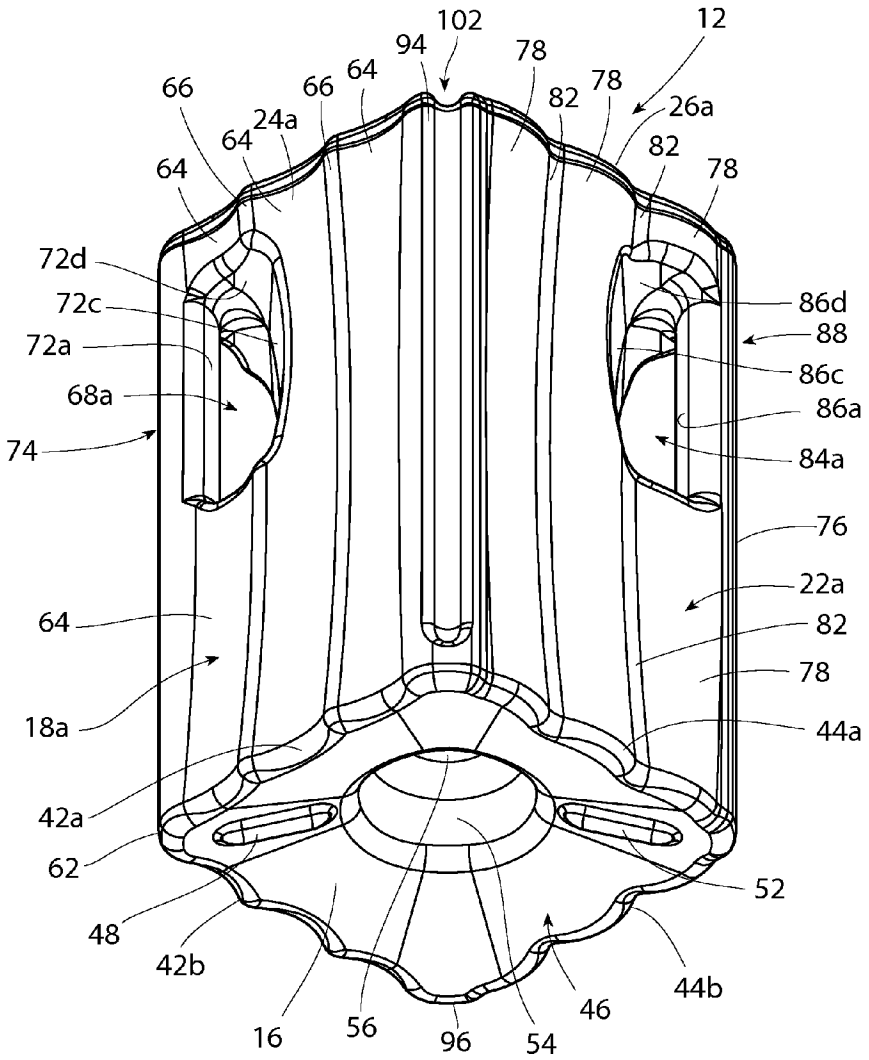
FIG. 2 is a lower perspective view of the container.
Figure 3:
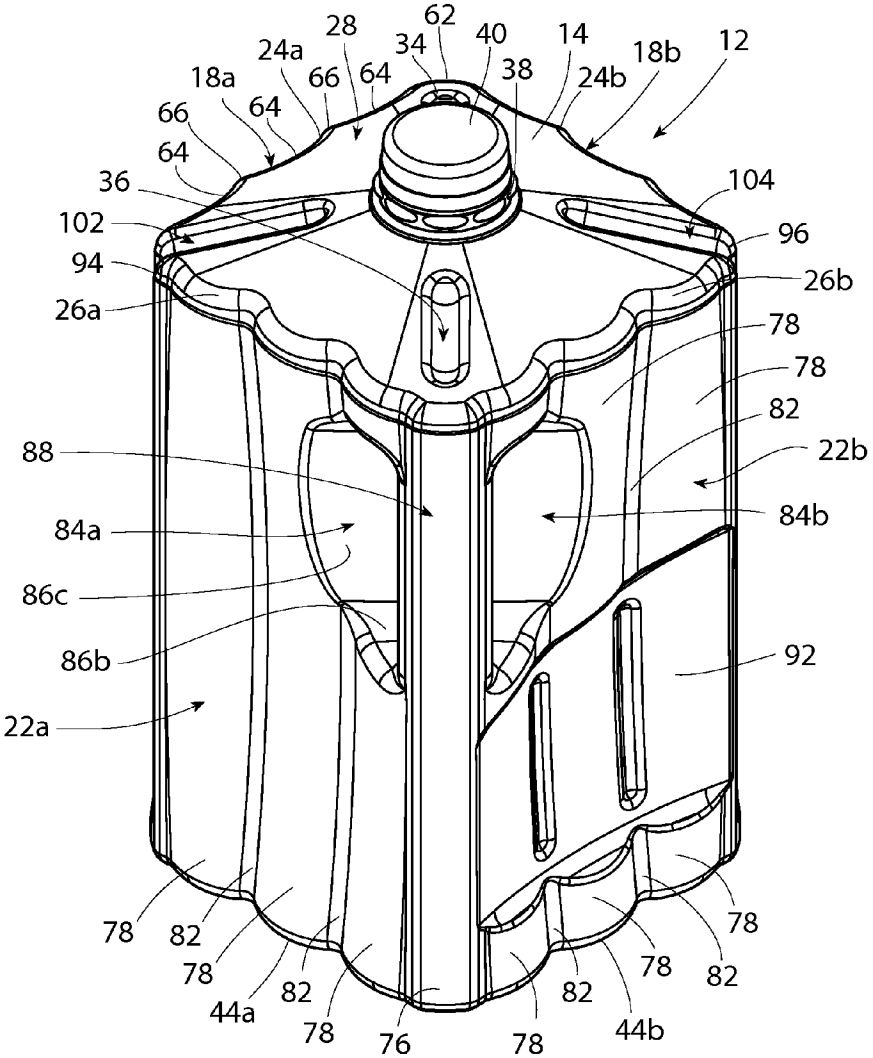
FIG. 3 is an upper perspective view of the container similar to that of FIG. 1, but with the container rotated to the left 90°.
Figure 4:
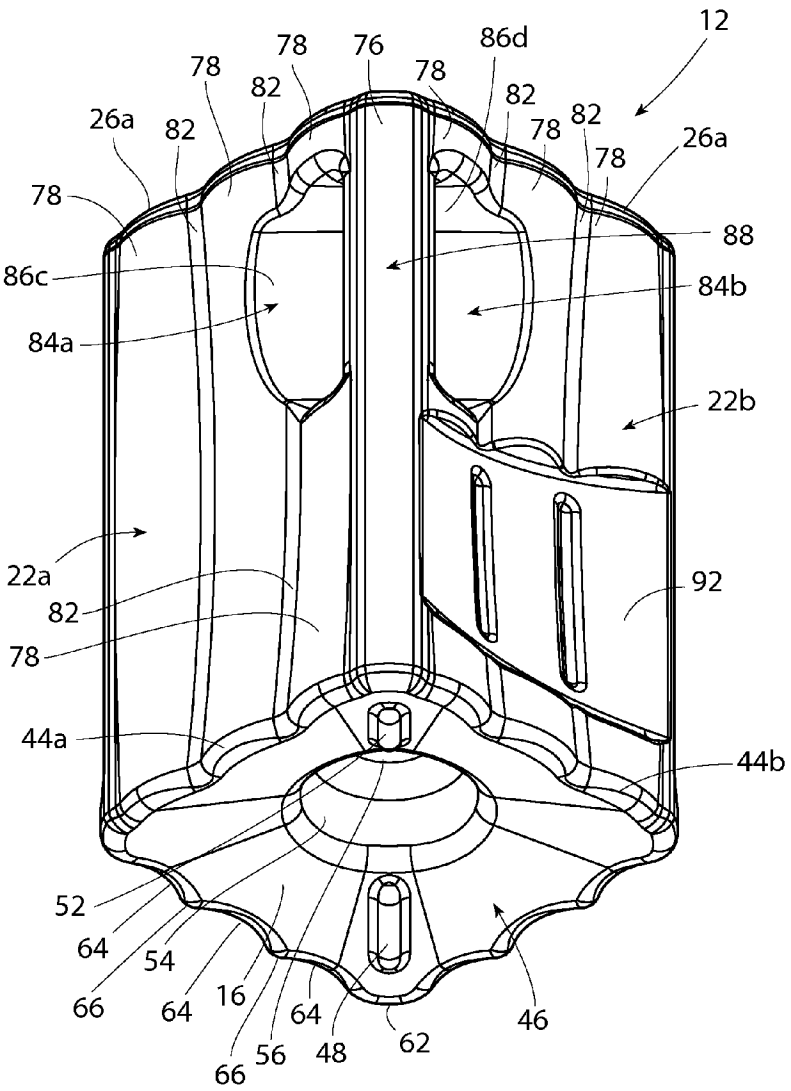
FIG. 4 is a bottom perspective view of the container as shown in FIG. 3.
Figure 5:
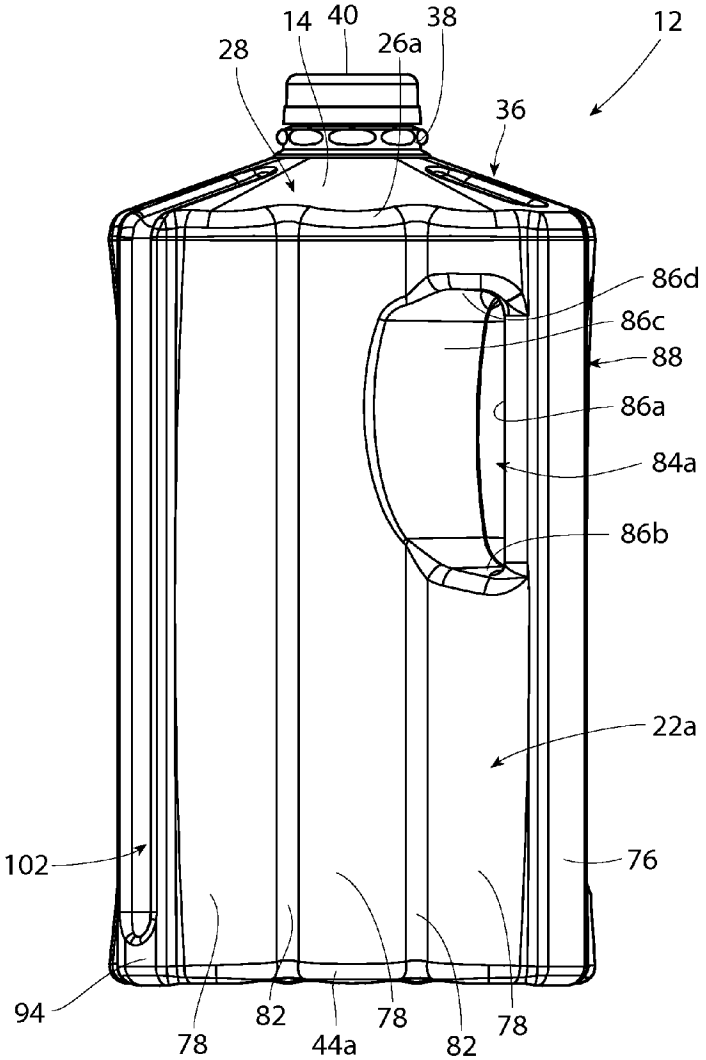
FIG. 5 is a side elevation view of the right side of the container as shown in FIG. 1.
Figure 6:
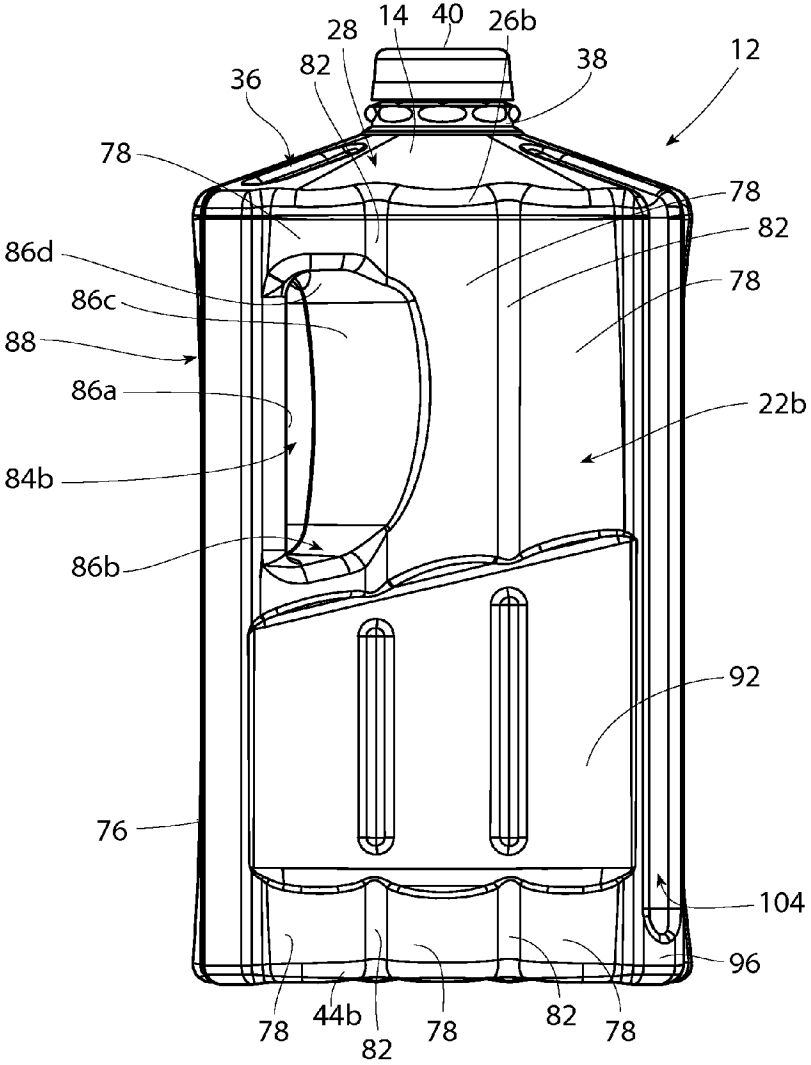
FIG. 6 is a side elevation view of the container rotated to the left 90 degrees from the view in FIG. 5.

FIGS. 1, 2 and 3 show perspective views of several sides of the pourable product container 12 of the invention. In the embodiment of the container shown in FIGS. 1, 2 and 3, the container 12 is a plastic, blow molded one gallon bottle. The container or bottle 12 is constructed to contain one gallon of a liquid such as milk or juice, or contain granular products such as salt or pet food. In the illustrated embodiment, the container 12 is constructed as a blow molded plastic container in order to construct the container as cost efficiently as possible. Other manufacturing techniques could be employed in constructing the container 12, as well as other materials. However, because conventional plastic blow molded containers are not particularly structurally strong, the particular construction of the container 12 to be described is well suited for enhancing the structural strength of a plastic blow molded container to enable several product filled containers to be arranged in a vertical stack with the bottom most container in the stack having sufficient structural strength to support the combined weight of the above product containers in the stack.

As seen in the drawing figures, the container 12 has a general cubic configuration that is defined by the combination of the rectangular or square top surface 14, the rectangular or square bottom surface 16 and the rectangular or square four side surfaces 18*a*, 18*b*, 22*a*, 22*b*. The four side surfaces 18*a*, 18*b*, 22*a*, 22*b* extend between and merge into the top surface 14 and the bottom surface 16. The first and second side surfaces 18*a*, 18*b* are mirror images of each other and therefore only one of the side surfaces 18*a* will be described in detail. The third and fourth side surfaces 22*a*, 22*b* are basically mirror images of each other and therefore only one of the third side surface 22*a* will be described in detail. A variation in the fourth side surface 22*b* that makes it different from the third side surface 22*a* will also be described.

The generally square configuration of the top surface 14 is defined by four top corner surfaces 24*a*, 24*b*, 26*a*, 26*b*. The top corner surfaces 24*a*, 24*b*, 26*a*, 26*b* extend around and border the top surface 14. The four top corner surfaces 24*a*, 24*b*, 26*a*, 26*b* extend across the tops of the respective side surfaces 18*a*, 18*b*, 22*a*, 22*b* and merge the side surfaces into the top surface 14. As seen in the drawing figures, the top corner surfaces 24*a*, 24*b*, 26*a*, 26*b* are rounded surfaces that form a smooth transition between the top surface 14 and the four side surfaces 18*a*, 18*b*, 22*a*, 22*b*. The top surface 14 has an upwardly sloped surface area 28 that is bounded by the four top corner surfaces 24*a*, 24*b*, 26*a*, 26*b*. The sloped surface is a low, inclined surface that gradually angles upwardly as it extends from the four top corner surfaces 24*a*, 24*b*, 24*c*, 24*d* inwardly toward the center of the top surface 14. A pair of short, narrow troughs 34, 36 are depressed into the sloped surface area 28. The troughs are positioned in line with opposite corners of the container. A cylindrical container neck 38 extends upwardly from the center of the sloped surface area 28. The neck 38 surrounds an opening to the container interior. A cylindrical cap 40 is screw threaded onto the neck 38. The cap 40 selectively closes and opens the opening to the container interior. Other equivalent types of closure devices could be used with the container 12 in place of the cap 40.

Figure 11:
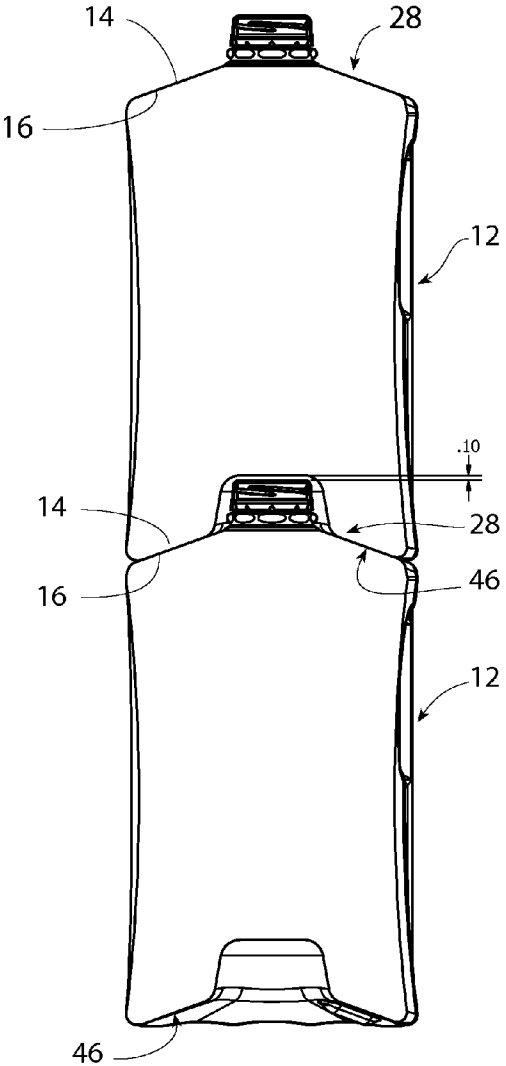
FIG. 11 is an elevation cross section view of two stacked containers.
Figure 12:
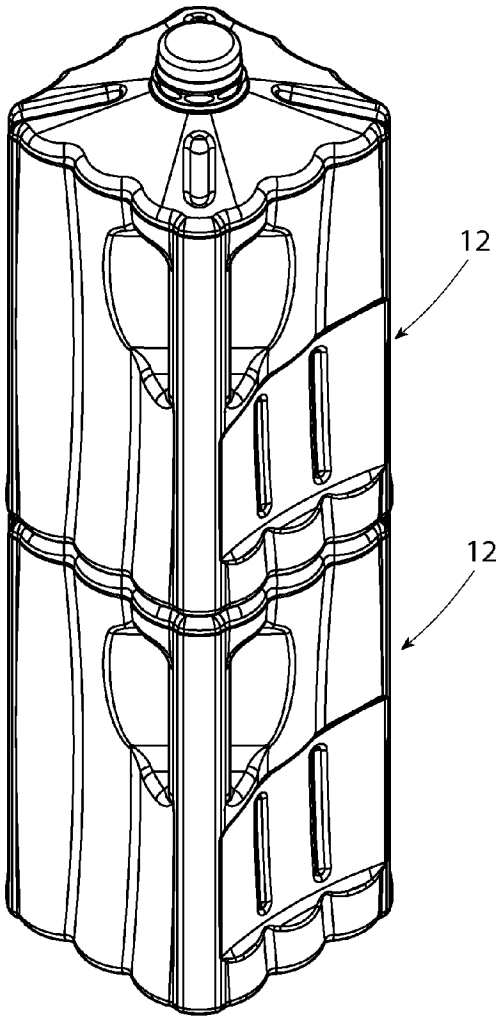
FIG. 12 is an upper perspective view of two stacked containers.
Figure 13:
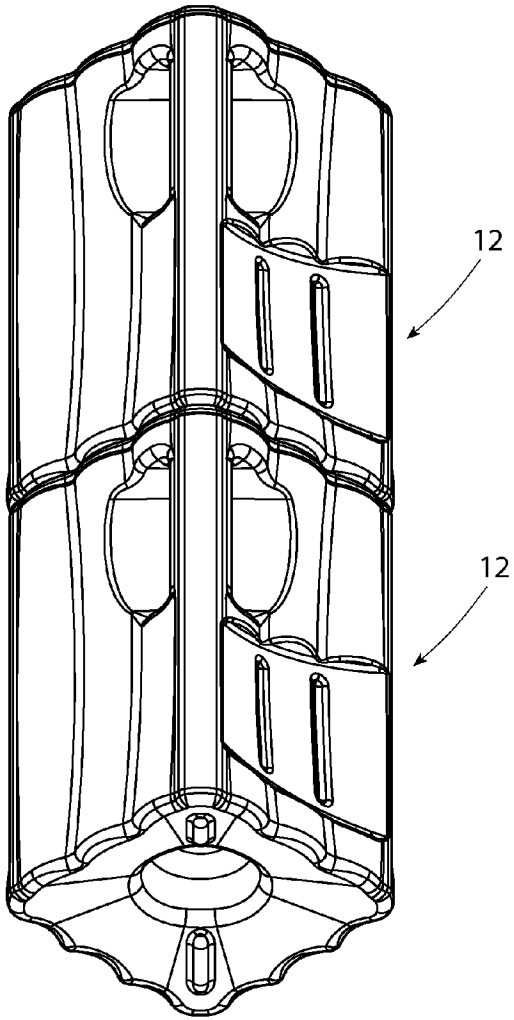
FIG. 13 is a lower perspective view of two stacked containers.
Figure 14:
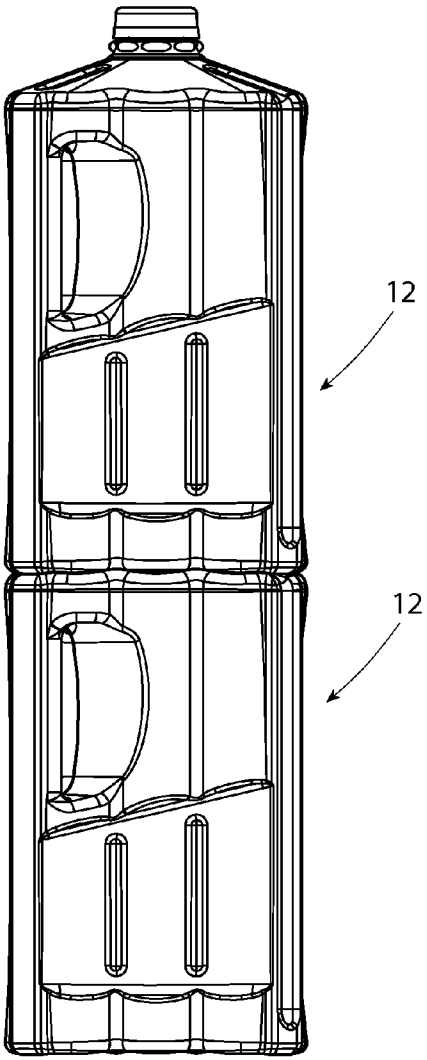
FIG. 14 is a side elevation view of two stacked containers.

The container bottom surface 16 also has a general square configuration defined by four bottom corner surfaces 42*a*, 42*b*, 44*a*, 44*b* that extend around and border the bottom surface 16. The bottom corner surfaces 42*a*, 42*b*, 44*a*, 44*b* extend across the bottoms of the respective side surfaces 18*a*, 18*b*, 22*a*, 22*b* and merge the side surfaces into the bottom surface 16. As seen in the drawing figures, the bottom corner surfaces 42*a*, 42*b*, 44*a*, 44*b* are rounded surfaces that smoothly transition the bottoms of the four side surfaces 18*a*, 18*b*, 22*a*, 22*b* into the bottom surface 16. The four bottom corner surfaces 42*a*, 42*b*, 44*a*, 44*b* surround and form a border around an upwardly sloped surface area 46 of the bottom surface 16. The sloped surface 46 is a low, inclined surface that gradually angles upwardly toward the interior of the container 12 as it extends from the four bottom corner surfaces 42*a*, 42*b*, 44*a*, 44*b* inwardly toward the center of the bottom surface 16. The angle of the sloped surface 46 on the bottom surface of the container is substantially the same as that of the sloped surface 28 on the top surface of the container. A pair of short, narrow ridges project outwardly from the sloped surface area 46 of the bottom surface. The ridges 48, 52 are positioned in line with opposite corners of the container and are aligned parallel with the troughs 34, 36 depressed into the sloped surface area 28 of the container top surface. A cylindrical interior wall 54 extends into the container interior from the sloped surface area 46 of the bottom surface 16. The cylindrical interior wall 54 is centered in the sloped surface 46 and extends into the container interior to a substantially flat circular surface 56. The interior diameter dimension of the cylindrical interior wall 54 is slightly larger than the exterior diameter dimension of the cap 40 and the neck 38 on the container top surface 14 as can be seen in FIG. 11. Additionally, the length that the cylindrical interior wall 54 extends into the container interior is slightly larger than the length that the neck 38 and attached cap 40 extend from the top of the container as can be seen in FIG. 11.

With the cylindrical interior wall 54 on the bottom surface 16 dimensioned just slightly larger than the container neck 38 and the cap 40, the bottom surface 16 of one container can be positioned on the top surface 14 of a second container as shown in FIG. 11 with the neck 30 and cap 40 of the second container fitting easily inside the cylindrical interior wall 54 of the one container. With the bottom sloped surface area 46 of the one container engaged and being supported on the top sloped surface area 28 of the second container, the engaging sloped surfaces 28, 46 and the cylindrical interior wall surrounding the neck 30 and cap 40 of the bottom container provide a coupling or link between the stacked containers that allows only limited side-to-side movement of the top container relative to the bottom container.

Additionally, the ridges 48, 52 on the bottom surface of the upper container are dimensioned to extend into and be received in the troughs 34, 36 on the top surface of the lower container. The ridges 48, 52 fitting into the troughs 34, 36 also provide a coupling or link between the stacked containers that allows for only limited relative side to side movement as well as limited rotational movement between the containers.

Figure 7:
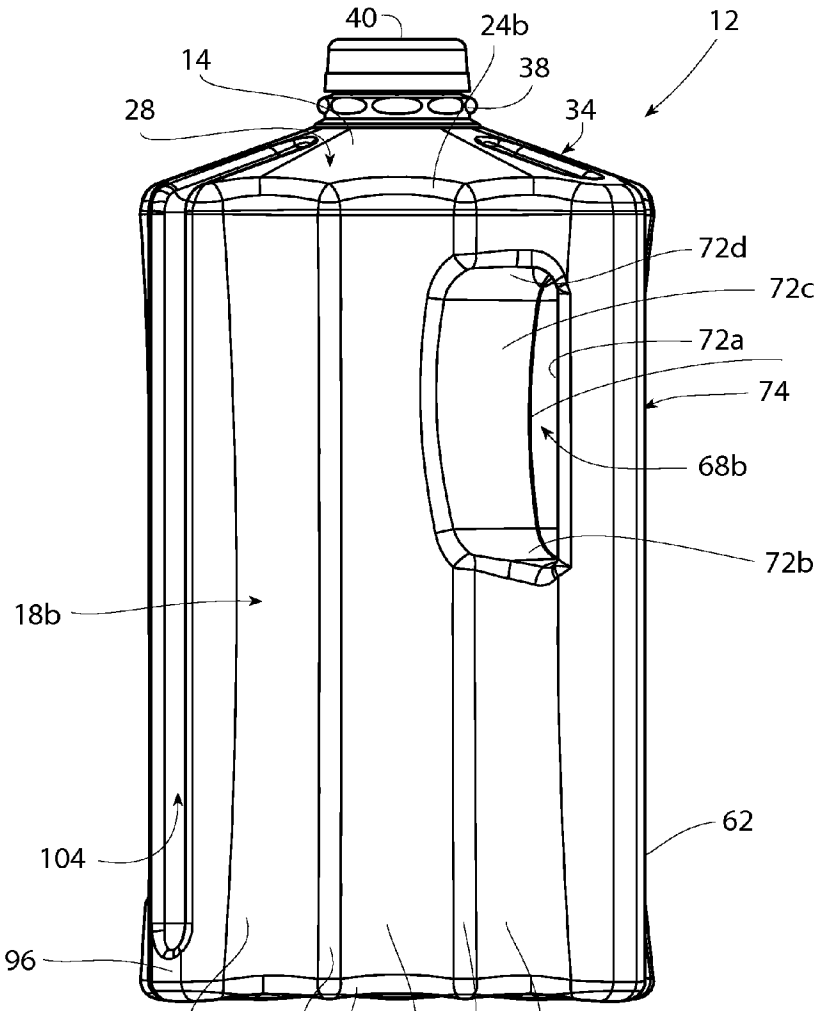
FIG. 7 is a side elevation view of the container rotated to the left 90 degrees from the view in FIG. 6.
Figure 8:
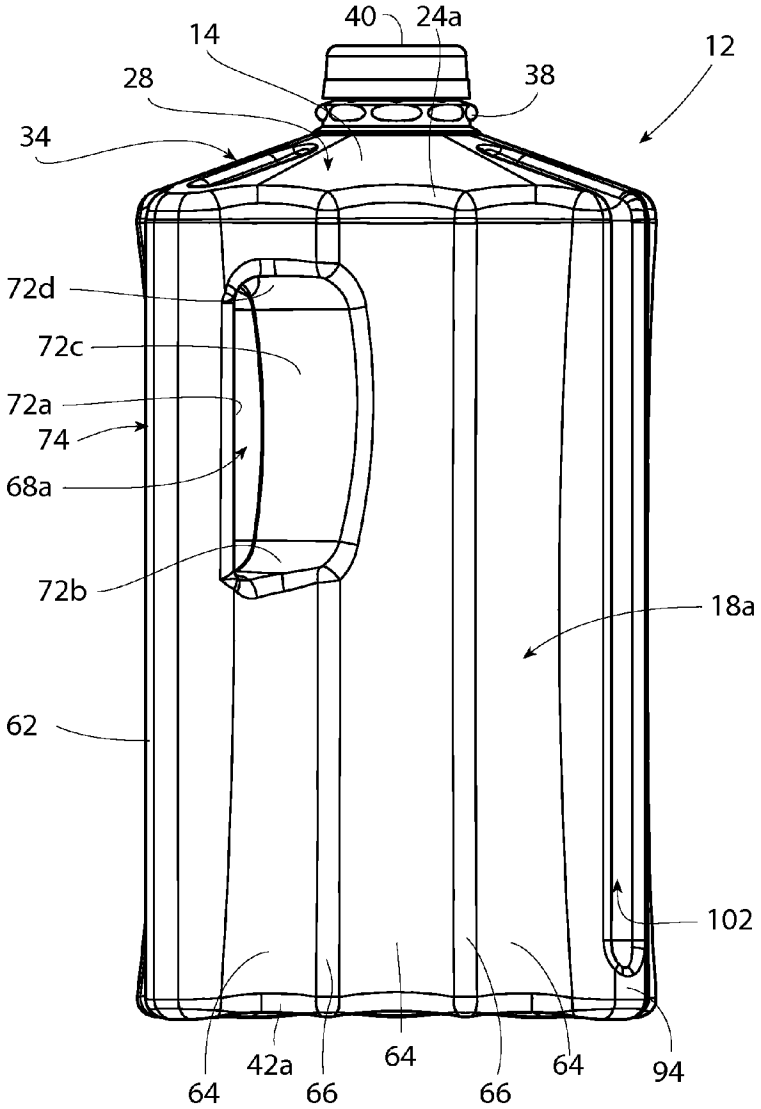
FIG. 8 is a side elevation view of the container rotated to the left 90 degrees from the view in FIG. 7.

Two adjacent side surfaces 18*a*, 18*b* of the four side surfaces merge smoothly together at a rounded side corner surface 62 that extends between the top surface 14 and bottom surface 16. The top end of the side corner surface 62 merges smoothly into adjacent ends of the top corner surface 24*a* and the top corner surface 24*b*. The opposite, bottom end of the side corner surface 62 merges smoothly into adjacent ends of the bottom corner surface 42*a* and of the bottom corner surface 42*b*. As stated earlier and as best seen in FIGS. 1, 7 and 8, the side surfaces 18*a*, 18*b* on opposite sides of the corner surface 62 are mirror images of each other. Each of the surfaces 18*a*, 18*b* is constructed with pluralities of concave groove surface sections 64. The concave groove surface sections 64 are substantially parallel and have lengths that extend between the top surface 14 and the bottom surface 16 and have widths that are sequentially arranged completely across the two side surfaces 18*a*, 18*b* of the container. The lengths of the groove surface sections 64 merge smoothly into the top corner surfaces 24*a*, 24*b* and into the bottom corner surfaces 42*a*, 42*b*, and thereby merge smoothly with the sloped surface areas 28, 46 of the top and bottom surfaces. The groove surface sections 64 form each of the side surfaces 18*a*, 18*b* as corrugation reinforced structures between the top surface 14 and the bottom surface 16. As seen in FIGS. 1, 7 and 8, the lengths and widths of the groove surface sections 64 occupy a majority of the areas of the side surfaces 18*a*, 18*b*. Only narrow peaks or ridges 66 formed where adjacent groove surface sections 64 meet separate adjacent groove surface sections from each other. Like the groove surface sections 64, the peaks or ridges 66 are substantially parallel and extend along the lengths of the groove surface sections 64 between the top surface 14 and bottom surface 16. The peaks or ridges 66, like the concave groove surface sections 64 function as corrugation reinforcement structures on the side surfaces 18*a*, 18*b*.

Openings 68*a*, 68*b* are formed in the two side surfaces 18*a*, 18*b*. As shown in the drawing figures, the openings 68*a*, 68*b* are positioned adjacent the top corner surfaces 24*a*, 24*b* and are separated by the side corner surface 62. The generally rectangular openings 68*a*, 68*b* are connected together by channel surfaces 72*a-d* that extend through the interior of the container 12 between the two openings 68*a*, 68*b*. The channel surfaces 72*a-d* form a passageway through the container 12 that is dimensioned to allow the fingers of a user's hand to easily pass through the passageway. Together the openings 68*a*, 68*b* and the channel surfaces 72*a-d* form a handle 74 on the side corner surface 62 of the container.

The other two adjacent side surfaces 22*a*, 22*b* merge smoothly together at a rounded side corner surface 76 between the two surfaces. A top end of the side corner surface 76 merges smoothly into adjacent ends of the top corner surface 26*a* and the top corner surface 26*b*. A bottom end of the side corner surface 76 merges smoothly into adjacent ends of the bottom corner surface 44*a* and the bottom corner surface 44*b*.

As best seen in FIGS. 3-6, the other two side surfaces 22*a*, 22*b* on opposite sides of the corner surface 76 are basically mirror images of each other. Each of the side surfaces 22*a*, 22*b* is formed with pluralities of convex rib surface sections 78. The convex rib surface sections 78 are substantially parallel and have lengths that extend between the container top surface 14 and bottom surface 16, and widths that are sequentially arranged completely across the two side surfaces 22*a*, 22*b* of the container. The top ends of each of the rib surface sections 78 on the side surfaces 22*a*, 22*b* merge smoothly into the respective top corner surfaces 26*a*, 26*b* and thereby merge smoothly with the sloped surface area 28 of the top surface 14. The bottom ends of each of the rib surface sections 78 on the side surfaces 22*a*, 22*b* merge smoothly into the respective bottom corner surfaces 44*a*, 44*b* and thereby merge smoothly into the sloped surface area 46 of the bottom surface 16. The rib surface sections 78 form each of the two side surfaces 22*a*, 22*b* as corrugation reinforced structures extending between the top surface 14 and the bottom surface 16. The lengths and widths of the rib surface sections 78 occupy a majority of the areas of the side surfaces 22*a*, 22*b*. Only narrow slots or valleys 82 formed where adjacent rib surface sections 78 meet separate adjacent rib surface sections from each other. Like the rib surface sections 78, the slots or valleys 82 are substantially parallel and extend along the lengths of the rib surface sections 78 between the top surface 14 and the bottom surface 16. The slots or valleys 82, like the rib surface sections 78 function as corrugation reinforcement structures on the side surfaces 22*a*, 22*b*.

As stated earlier, the fourth side surface 22*b* has a variation that makes it different from the third side surface 22*a*. The fourth side surface 22*b* is provided with a generally planar surface area 92 on a central area of the side surface 22*b*. This planar surface area 92 is provided for the easy attachment of a label to the container 12.

In the same manner as with the first and second side surfaces 18*a*, 18*b*, openings 84*a*, 84*b* are formed in the third and fourth side surfaces 22*a*, 22*b*. The openings 84*a*, 84*b* are positioned adjacent the top corner surfaces 26*a*, 26*b* and are separated by the side corner surface 76. The openings 84*a*, 84*b* are connected together by channel surfaces 86*a-d* that extend through the interior of the container 12 between the two openings. The channel surfaces 86*a-d* form a passageway through the container 12 that is dimensioned to allow the fingers of a users hand to easily pass through the passageway. Together the openings 84*a*, 84*b* and the channel surfaces 86*a-d* form a second handle 88 on the side corner surface 76 of the container that is opposite the first handle 74.

The pair of handles 74, 88 formed in the respective opposite side corner surfaces 62, 76 not only make it easier to carry the container 12 after it has been filled, but the constructions of the handles 74, 88 add structure and additional plastic material at the opposite corners 62, 76 that reinforce these corners for supporting the loads of several stacked filled containers.

Figure 9:
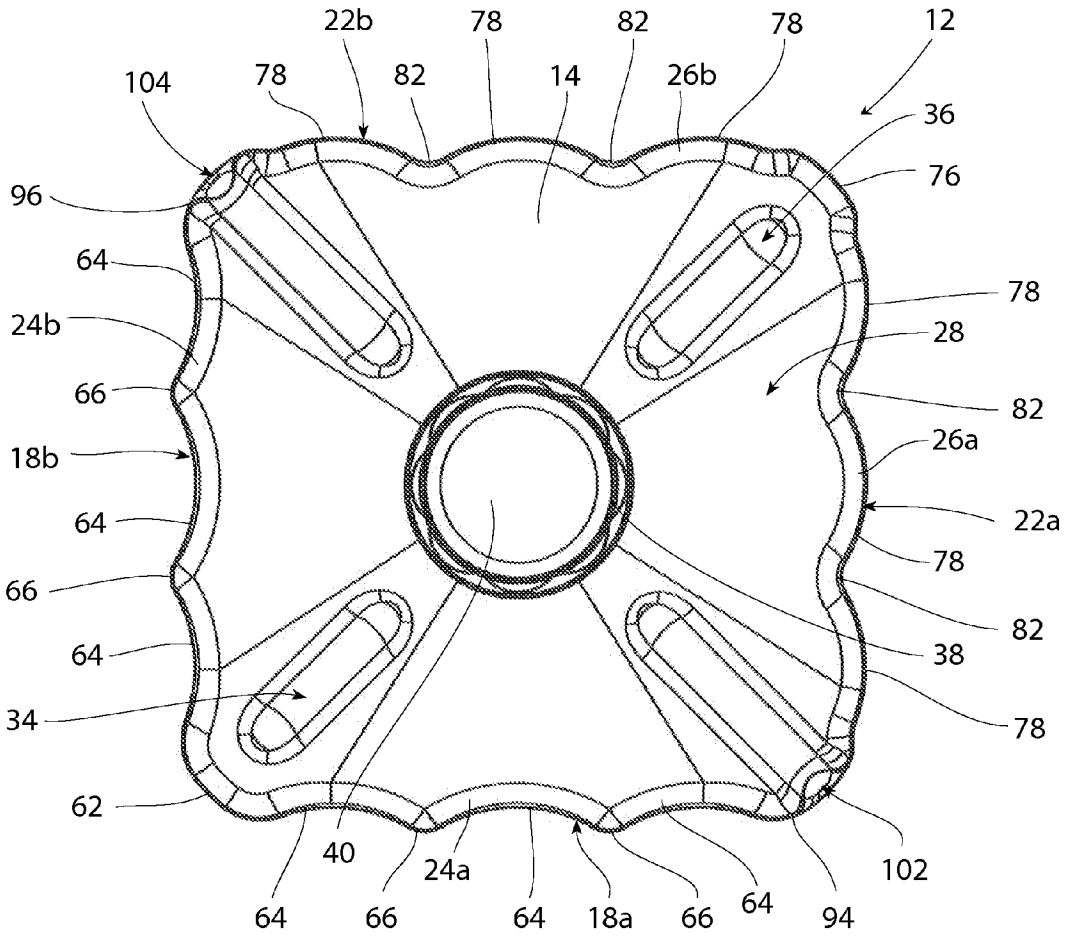
FIG. 9 is a top plan view of the container.
Figure 10:
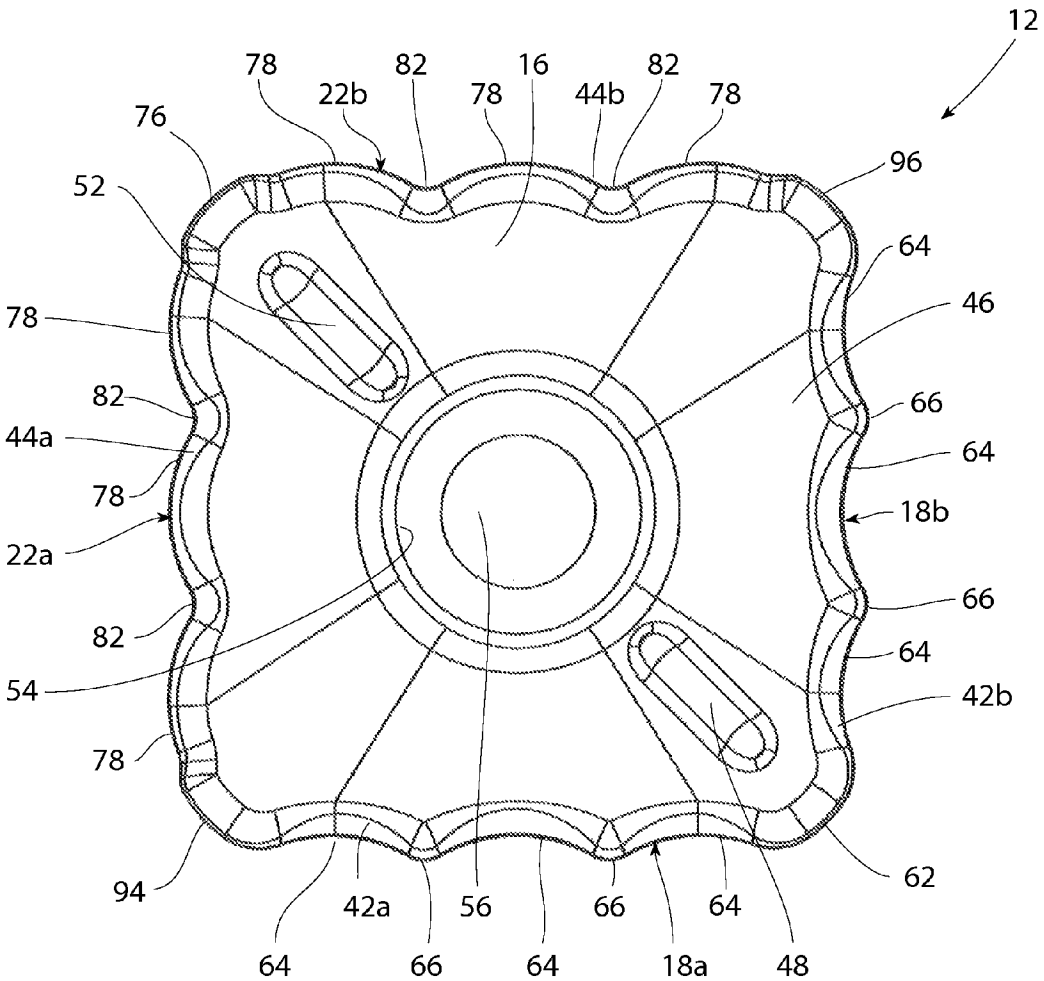
FIG. 10 is a bottom plan view of the container.

As shown in FIGS. 1, 2 and 9, the first 18*a* and third 22*a* side surfaces merge smoothly together at a generally rounded side corner surface 94 and the second 18*b* and fourth 22*b* side surfaces merge smoothly together at a generally rounded side corner surface 96. These corner surfaces 94, 96 also extend between the top surface 14 and bottom surface 16 of the container. These corners surfaces 94, 96 differ from the other corners surfaces 62, 76 of the container in that they are also provided with elongate grooves 102, 104 depressed into the side corner surfaces 94, 96. The grooves 102, 104 extend upwardly from adjacent the bottom surface 16 of the container to the container top surface 14, and then portions of the grooves 102, 104 extend inwardly across the container top surface 14 toward the container neck 38. These grooves 102, 104 also add structure and additional plastic material that reinforce their associated side corner surfaces 94, 96 for supporting the loads of several stacked filled containers.

Each of the four side surfaces 18*a* 18*b*, 22*a*, 22*b* are formed where the surfaces bow inwardly toward the interior of the container 12 between the top 14 and bottom 16 surfaces of the container and between the side corner surfaces on opposite sides of the side surfaces. The inwardly bowed configuration of the side surfaces preloads the surfaces inwardly and reinforces the surfaces against bulging outwardly when the container interior is filled.

The convex rib surface sections 78 are complementary to the concave groove surface sections 64. The convex rib surface sections 78 of one container fit into the concave groove surface sections 64 of a second container. This enables pluralities of containers 12 to be arranged in a two dimensional array with the convex rib surface sections 78 and the concave groove surface sections 64 of adjacent containers engaging each other. In this manner a tight fit two dimensional arranged layer of containers 12 can be formed on a pallet surface with the engagement between the side surfaces 18*a*, 18*b*, 22*a*, 22*b* of adjacent containers resisting relative movement between the containers and also making efficient use of the surface area of the pallet. Additionally, the concave groove surface sections 64, the ridges 66, convex rib surface sections 78 and the valleys 82 on the side surfaces of the containers in the two dimensionally arranged layer of containers provide the bottom layer of containers with enhanced structural strength for supporting additional two dimensionally arrayed layers of containers stacked on the bottom layer of containers. Furthermore, the pair of handles formed at opposite corners of the containers and the pair of grooves formed in the opposite corners of the containers add additional structure to the corners and further enhance the structural strength of a two-dimensional arranged layer of containers for supporting additional two-dimensionally arranged layers of containers stacked on the bottom layer of containers. Furthermore, the necks and caps of the containers in lower layers engaging in the cavities of the containers in upper layers, and the ridges of containers in the upper layers engaging in the troughs of containers in the lower layers resist relative side to side movement and relative rotational movement between stacked containers.

The plastic blow molded container 12 of the invention described herein has enhanced structural strength to support additional layers of like containers stacked on the container. Furthermore, the construction of the container described herein resists relative movement between adjacent containers in a two dimensionally arranged layer of containers and resists relative movement between containers stacked on each other.

As various modifications could be made in the construction of the container of the invention herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above described exemplary embodiments, but should be defined only in accordance with the following claims appended hereto and their equivalents.

The invention claimed is:

1. A pourable product container comprising:

a rectangular upwardly sloped top surface having a cylindrical neck projecting from a center of the top surface, the neck surrounding an opening to an interior of the container;

a cap on the neck;

a rectangular bottom surface opposite the top surface, the bottom surface being upwardly sloped toward a center of the bottom surface;

four rectangular side surfaces extending between the top surface and the bottom surface, two of the side surfaces having pluralities of consecutive concave groove surface sections immediately adjacent on another and having widths sequentially arranged side by side extending across the entire width of the two side surfaces with only narrow ridges formed where adjacent groove surface sections and lengths extending across the two side surfaces between that merge into the top surface and the bottom surface; another two of the side surfaces having pluralities consecutive of convex rib surface sections immediately adjacent on another and having widths sequentially arranged side by side extending across the entire width of the other two side surfaces with only narrow valleys formed where adjacent rib surface sections and lengths extending across the other two side surfaces between that merge into the top surface and the bottom surface;

a pair of rounded side corner surfaces extending between the top surface and the bottom surface and merging into the top surface and the bottom surface on opposite sides of the container, each of the side corner surfaces separating two adjacent side surfaces of the four side surfaces and merging into the two adjacent side surfaces; and a pair of openings formed into each of the two adjacent side surfaces on opposite sides of each of the pair of side corner surfaces separating the two adjacent side surfaces, the pair of openings connecting through the container interior and forming a handle on each of the pair of side corner surfaces.

2. The container of claim 1, further comprising;

the container being constructed entirely of plastic.

3. The container of claim 1, further comprising:

a second pair of rounded side corner surfaces extending between the top surface and the bottom surface and merging into the top surface and the bottom surface on opposite sides of the container, each of the second pair of side corner surfaces separating two adjacent side surfaces of the four side surfaces and merging into the two adjacent side surfaces; and, a pair of grooves depressed into the second pair of side corner surfaces with each groove extending along the side corner surface between the top surface and the bottom surface, the grooves adding structure and additional material to the second pair of side corner surfaces that reinforce the second pair of side corner surfaces.

4. The container of claim 1, further comprising:

a pair of separate troughs depressed into the top surface;

a pair of separate ridges projecting outwardly from the bottom surface, the pair of ridges of a first upper container extend into and are received inside the pair of troughs of a second lower container when the bottom surface of the first upper container is positioned on and supported by the top surface of the second lower container.

5. The container of claim 1, further comprising:

the concave groove surface sections and the convex rib surface sections being complementary wherein the convex rib surface sections of a first container will fit into the concave groove surface sections of a second container when one of the two side surfaces having the pluralities of convex rib surface sections of the first container is positioned against one of the other two side surfaces having the pluralities of concave groove surface sections of the second container.

6. The container of claim 1, further comprising:

the top surface, the bottom surface and the four side surfaces together define a cubic configuration of the container.

7. A pourable product container comprising:

a rectangular, upwardly sloped top surface having a cylindrical neck projecting from a center of the top surface, the neck surrounding an opening into an interior of the container;

a cap on the neck;

a rectangular bottom surface opposite the top surface, the bottom surface being upwardly sloped toward a center of the bottom surface;

four rectangular side surfaces extending between the top surface and the bottom surface, two of the side surfaces having pluralities of consecutive concave grooved surface sections immediately adjacent one another and having widths sequentially arranged side-by-side extending completely across the entire width of the two side surfaces with only narrow ridges formed where adjacent groove surface sections meet, and lengths extending across the two side surfaces that merge into the top surface and the bottom surface; another two of the side surfaces having pluralities of consecutive convex rib surface sections immediately adjacent one another and having widths sequentially arranged side-by-side extending across the entire width of the other two side surfaces, with only narrow valleys formed where adjacent rib surface sections meet, and lengths extending across the other two side surfaces that merge into the top surface and the bottom surface;

a first pair of rounded side corner surfaces extending between the top surface and the bottom surface and merging into the top surface and the bottom surface on opposite sides of the container, each of the first pair of side corner surfaces separating two adjacent side surfaces of the four side surfaces and merging into the two adjacent side surfaces;

a pair of grooves depressed into the first pair of side corner surfaces with each groove extending along the side corner surface between the top surface and the bottom surface, the grooves adding structure and additional material to the first pair of side corner surfaces that reinforce the first pair of side corner surfaces;

a second pair of rounded side corner surfaces extending between the top surface and the bottom surface and merging into the top surface and the bottom surface on opposite sides of the container, each of the second pair of side corner surfaces separating two adjacent side surfaces of the four side surfaces and merging into the two adjacent side surfaces; and, a pair of openings formed into each of the two adjacent side surfaces on opposite sides of each of the second pair of side corner surfaces separating the two adjacent side surfaces, the pair of openings connecting through the container interior and forming a handle on each of the second pair of side corner surfaces.

8. The container of claim 7, further comprising:

the container being constructed entirely of plastic.

9. The container of claim 7, further comprising:

a pair of separate troughs depressed into the top surface;

a pair of separate ridges projecting outwardly from the bottom surface, the pair of ridges being positioned on the bottom surface and being dimensioned whereby the pair of ridges of a first upper container extend into and are received inside the pair of troughs of a second lower container when the bottom surface of the first upper container is positioned on and supported by the top surface of the second lower container.

* * * * *